US012305320B2

(12) United States Patent
Je et al.

(10) Patent No.: US 12,305,320 B2
(45) Date of Patent: May 20, 2025

(54) CONTROL METHOD OF CLOTHES DRYER

(71) Applicant: LG Electronics Inc., Seoul (KR)

(72) Inventors: Haeyoon Je, Seoul (KR); Ingeon Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 1156 days.

(21) Appl. No.: 17/155,883

(22) Filed: Jan. 22, 2021

(65) Prior Publication Data

US 2021/0140092 A1 May 13, 2021

Related U.S. Application Data

(63) Continuation of application No. 16/196,417, filed on Nov. 20, 2018, now Pat. No. 10,947,661.

(30) Foreign Application Priority Data

Nov. 20, 2017 (KR) ..... 10-2017-0154928

(51) Int. Cl.
*D06F 58/20* (2006.01)
*D06F 58/38* (2020.01)
(Continued)

(52) U.S. Cl.
CPC ..... *D06F 58/206* (2013.01); *D06F 58/38* (2020.02); *D06F 2101/20* (2020.02);
(Continued)

(58) Field of Classification Search
CPC ..... D06F 58/206; D06F 58/30; D06F 25/00; D06F 2103/50; D06F 2105/26;
(Continued)

(56) References Cited

U.S. PATENT DOCUMENTS 524,576 A 8/1894 Cooper
4,485,566 A 12/1984 Vivares
(Continued)

FOREIGN PATENT DOCUMENTS

CN 101725019 6/2010
CN 103882665 6/2014
(Continued)

OTHER PUBLICATIONS

Office Action in Korean Appln. No. 10-2022-0031999, dated Jun. 17, 2022, 11 pages (with English translation).
(Continued)

*Primary Examiner* — Edelmira Bosques
*Assistant Examiner* — Bao D Nguyen
(74) *Attorney, Agent, or Firm* — Fish & Richardson P.C.

(57) ABSTRACT

A dryer includes a heat pump system provided as a heat source for heating air supplied to a drum. The dryer includes a controller configured to perform operations that include selecting one of a plurality of operation modes in which initial driving frequencies are different from one another and inputting a drying start command to the dryer by a user, checking an outer temperature and comparing the outer temperature with a preset reference temperature T, performing the operation mode selected by the user, in a case where the outer temperature is equal to or more than the reference temperature T, performing an operation mode in which the initial driving frequency of the compressor is the highest of the plurality of operation modes, in a case where the outer temperature is less than the reference temperature T.

14 Claims, 4 Drawing Sheets

(51) Int. Cl.

| | |
|---|---|
| *D06F 101/20* | (2020.01) |
| *D06F 103/32* | (2020.01) |
| *D06F 103/34* | (2020.01) |
| *D06F 103/50* | (2020.01) |
| *D06F 105/26* | (2020.01) |
| *D06F 105/46* | (2020.01) |
| *D06F 105/54* | (2020.01) |

(52) U.S. Cl.
CPC ..... *D06F 2103/32* (2020.02); *D06F 2103/34* (2020.02); *D06F 2103/50* (2020.02); *D06F 2105/26* (2020.02); *D06F 2105/46* (2020.02); *D06F 2105/54* (2020.02)

(58) Field of Classification Search
CPC .. D06F 2202/04; D06F 34/00; D06F 2103/00; D06F 2105/00; D06F 2204/06; D06F 2204/10; D06F 2105/46; D06F 2105/54; D06F 2103/32; D06F 2103/34; D06F 58/38; F25B 49/022
See application file for complete search history.

(56) References Cited

U.S. PATENT DOCUMENTS

| | | | |
|---|---|---|---|
| 2005/0066538 | A1 | 3/2005 | Goldberg et al. |
| 2005/0199016 | A1 | 9/2005 | Tadano et al. |
| 2005/0217133 | A1 | 10/2005 | Yakumaru et al. |
| 2006/0048404 | A1 | 3/2006 | Tadano et al. |
| 2006/0048405 | A1 | 3/2006 | Baek et al. |
| 2006/0053651 | A1 | 3/2006 | Tadano et al. |
| 2006/0162182 | A1 | 7/2006 | Wong et al. |
| 2006/0179681 | A1 | 8/2006 | Tamura et al. |
| 2007/0107255 | A1 | 5/2007 | Tamura et al. |
| 2007/0145941 | A1 | 6/2007 | Asada et al. |
| 2007/0251119 | A1 | 11/2007 | Kim et al. |
| 2008/0031756 | A1 | 2/2008 | Hwang et al. |
| 2009/0183385 | A1 | 7/2009 | Lee et al. |
| 2010/0077787 | A1 | 4/2010 | Masuda et al. |
| 2011/0277334 | A1 | 11/2011 | Lee et al. |
| 2011/0280736 | A1 | 11/2011 | Lee et al. |
| 2011/0289794 | A1 | 12/2011 | Noh et al. |
| 2012/0079736 | A1 | 4/2012 | Lee et al. |
| 2012/0079737 | A1 | 4/2012 | Lee et al. |
| 2012/0144693 | A1 | 6/2012 | Wakizaka |
| 2012/0186305 | A1 | 7/2012 | Taniguchi et al. |
| 2013/0232813 | A1 | 9/2013 | Heo et al. |
| 2013/0340278 | A1 | 12/2013 | Pillot et al. |
| 2014/0013614 | A1 | 1/2014 | Choi |
| 2014/0033745 | A1 | 2/2014 | Pillot et al. |
| 2014/0041249 | A1 | 2/2014 | Jung et al. |
| 2014/0060092 | A1 | 3/2014 | Pillot et al. |
| 2014/0109436 | A1 | 4/2014 | Noh et al. |
| 2014/0298676 | A1 | 10/2014 | Oak et al. |
| 2014/0366397 | A1 | 12/2014 | Wakizaka et al. |
| 2015/0069933 | A1 | 3/2015 | Ragogna et al. |
| 2015/0121718 | A1 | 5/2015 | Huang et al. |
| 2015/0322618 | A1 | 11/2015 | Bisaro et al. |
| 2016/0002843 | A1 | 1/2016 | Han et al. |
| 2016/0047081 | A1 | 2/2016 | Lee et al. |
| 2016/0145793 | A1 | 5/2016 | Ryoo et al. |
| 2017/0260683 | A1 | 9/2017 | Simon et al. |
| 2017/0356122 | A1 | 12/2017 | Xu et al. |
| 2018/0080169 | A1 | 3/2018 | Je et al. |
| 2018/0142408 | A1 | 5/2018 | Ahn et al. |
| 2018/0190093 | A1 | 7/2018 | Krula |
| 2018/0266043 | A1 | 9/2018 | Kim et al. |
| 2020/0263346 | A1 | 8/2020 | Lee et al. |

FOREIGN PATENT DOCUMENTS

| | | | | |
|---|---|---|---|---|
| CN | 105051281 | | 11/2015 | |
| CN | 106592185 | | 4/2017 | |
| CN | 107841861 | | 3/2018 | |
| EP | 2182104 | | 5/2010 | |
| EP | 2733257 | A1 * | 5/2014 | ..... D06F 58/38 |
| JP | 2010082112 | | 4/2010 | |
| JP | 2014018452 | | 2/2014 | |
| JP | 2014233475 | | 12/2014 | |
| JP | 2015156943 | | 9/2015 | |
| KR | 1020050118484 | | 12/2005 | |
| KR | 1020060014845 | | 2/2006 | |
| KR | 1020070069025 | | 7/2007 | |
| KR | 1020130101912 | | 9/2013 | |
| KR | 1020140094434 | | 7/2014 | |
| KR | 20160020346 | | 2/2016 | |
| WO | WO2018050012 | | 3/2018 | |

OTHER PUBLICATIONS

Extended European Search Report in European Application No. 18206984.9, May 14, 2019, 7 pages.
Office Action in Chinese Appln. No. 201880073441.0, dated Dec. 3, 2021, 13 pages (with English translation).

* cited by examiner

CONTROL METHOD OF CLOTHES DRYER

CROSS-REFERENCE TO RELATED APPLICATIONS

The present application is a continuation of U.S. application Ser. No. 16/196,417, filed on Nov. 20, 2018, which claims priority under 35 U.S.C. 119 and 35 U.S.C. 365 to Korean Patent Application No. 10-2017-0154928, filed on Nov. 20, 2017. The disclosures of the prior applications are incorporated by reference in their entirety.

FIELD

The present invention relates to a control method of a dryer.

BACKGROUND

In general, a clothes processing apparatus having a drying function such as a washing machine or a dryer is a device for supplying hot air to input wet clothing to evaporate moisture of laundry.

For example, the dryer may include a drum which is rotatably installed in a main body and into which laundry is input, a driving motor which drives the drum, a blowing fan that blows air into the drum, and heating means which heat air which flows into the drum.

Meanwhile, the dryer can be classified into a circulation type dryer and an exhaust type dryer according to a method of discharging hot and humid air. The air that exits the drum has the moisture of the laundry inside the drum and becomes hot and humid air. The circulation type dryer has a system in which hot and humid air is circulated without being discharged to the outside of the dryer and the air is cooled to below the dew point temperature through the heat exchange means to condense the moisture contained in the hot and humid air and re-supplies the air. The exhaust type dryer has a method of directly discharging the hot and humid air through the drum to the outside.

Meanwhile, there may be a heater system which uses high-temperature electrical resistance heat generated by electrical resistance as the heating means, or uses combustion heat generated by burning gas.

Alternatively, the heating means may be a heat pump system. The heat pump system includes a heat exchanger, a compressor, and an expander. The refrigerant circulating through the system heats the air supplied to the drum after collecting the energy of the hot air exhausted from the drum, thereby increasing energy efficiency.

Specifically, the heat pump system has an evaporator on the exhaust side and a condenser on the drum inflow side from the drum, and the heat energy is absorbed by the refrigerant through the evaporator and then heated to high temperature and high pressure by the compressor. Then, the heat energy of the refrigerant is transferred to the air flowing into the drum through the condenser and thus hot air is generated by using the waste energy.

In recent years, dryers to which a heat pump system with high energy efficiency is applied have been actively developed.

Korean Patent Laid-Open Publication No. 10-2013-0101912, which is a related art document, discloses a dryer to which a heat pump system is applied.

Meanwhile, in a case of the dryer to which the heat pump system is applied, when the outer temperature is low, the refrigerant cannot be heated sufficiently, so that the sucked air cannot be heated sufficiently, resulting in a problem that the drying performance of the dryer is greatly deteriorated. Therefore, it is required to develop a technique capable of improving the heating properties of the air corresponding to the outer temperature.

According to the related art, in a case where the outer temperature is low, the content capable of improving the heating properties corresponding to the outer temperature is not disclosed, so that the drying performance may be deteriorated in a state where the outer temperature is low.

According to the related art, there is provided a high-speed drying mode in which a heater is additionally used as a heat source together with a heat pump system to improve a drying performance. However, since a heater is additionally required, manufacturing cost may greatly increase and power consumption may increase.

Meanwhile, in a case of the dryer using the heat pump system, the capacity of the compressor for compressing the refrigerant to a high temperature serves as an important factor in the performance of the system.

However, since the space inside the dryer is limited, it is limited to increase the size of the compressor to increase the capacity of the capacity. In addition, as the capacity of the compressor increases, the compression performance of the refrigerant is improved, but vibration and noise increase, which can greatly reduce the user product satisfaction. Therefore, it is required to develop a heat pump system capable of exhibiting sufficient performance with less occurrence of vibration.

SUMMARY

An objective of the present invention is to provide a control method of a dryer to which a heat pump system capable of effectively exhibiting drying performance of a dryer in a low-temperature use environment is applied.

An objective of the present invention is to provide a control method of a dryer to which a heat pump system capable of reducing noise and vibration during driving is applied.

A control method of a dryer according to an embodiment of the present invention in which a heat pump system is provided as a heat source for heating air supplied to a drum includes selecting one of a plurality of operation modes in which initial driving frequencies are different from each other and inputting a drying start command to the dryer by a user [S10]; checking an outer temperature and comparing the outer temperature with a preset reference temperature T by a control unit [S20]; performing the operation mode selected by the user by the control unit, in a case where the outer temperature is equal to or more than the reference temperature T [S45]; determining the driving environment of the dryer as a lower temperature state and performing an operation mode in which the initial driving frequency of the compressor is the highest of the plurality of operation modes, in a case where the outer temperature is less than the reference temperature T [S50].

In addition, the plurality of operation modes includes a speed mode in which the initial driving frequency and the variable minimum frequency of the compressor is highest; a standard mode in which the initial driving frequency and the variable minimum frequency of the compressor is lower than the speed mode; and an energy mode in which the initial driving frequency and the variable minimum frequency of the compressor is lower than the standard mode.

In addition, the control method of a dryer includes checking the outlet side temperature of the compressor and comparing the outlet side temperature of the compressor and a preset reference temperature C1 by the control unit [S60]; and determining that the compressor is in an overloaded state and performing a low-speed mode is operated at a variable frequency lower than the variable minimum frequency of the compressor in the operation mode being performed, in a case where the outlet side temperature of the compressor is equal to or more than the reference temperature C1 [S70].

In the low-speed mode, the variable frequency is lower than the variable minimum frequency of the others operation modes of the plurality of the operation modes.

In the low-speed mode, the lowest frequency of the compressor is larger than 0 Hz.

In addition, the control unit releases the low-speed mode and returns to the initial operation mode before the low-speed mode is performed, in a case where the control unit checks that the outlet side temperature of the compressor is less than the reference temperature C1, during performing of the low-speed mode.

In the low-speed mode, the control unit checks the outlet side temperature of the compressor at a predetermined cycle and decreases stepwise the frequency of the compressor by a set frequency reduction value H2.

In addition, the control method of a dryer includes determining whether or not the temperature inside the drum reaches a temperature state which is suitable for drying by comparing the outlet side temperature of the compressor with a preset reference temperature C2 by the control unit, in a state where one of the plurality of operation modes is performed; and decreasing the frequency of the compressor so that the control unit determines that the temperature inside the drum reaches a temperature which is suitable for drying and maintains the temperature, in a case where the outlet side temperature of the compressor is equal to or more than the reference temperature C2.

In addition, the control unit checks whether the outlet side temperature of the compressor is equal to or more than the reference temperature C2 at a predetermined cycle and decreases stepwise the frequency of the compressor by the set frequency reduction value H1, in a state where one of the plurality of operation modes is performed.

In addition, the frequency reduction value H2 is larger than the frequency reduction value H1.

In addition, the compressor is a twin rotary compressor.

In addition, an R134a refrigerant is used as a refrigerant of the heat pump system.

DETAILED DESCRIPTION

Reference will now be made in detail to the embodiments of the present disclosure, examples of which are illustrated in the accompanying drawings.

In the following detailed description of the preferred embodiments, reference is made to the accompanying drawings that form a part hereof, and in which is illustrated by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from another component(s).

Figure 1:
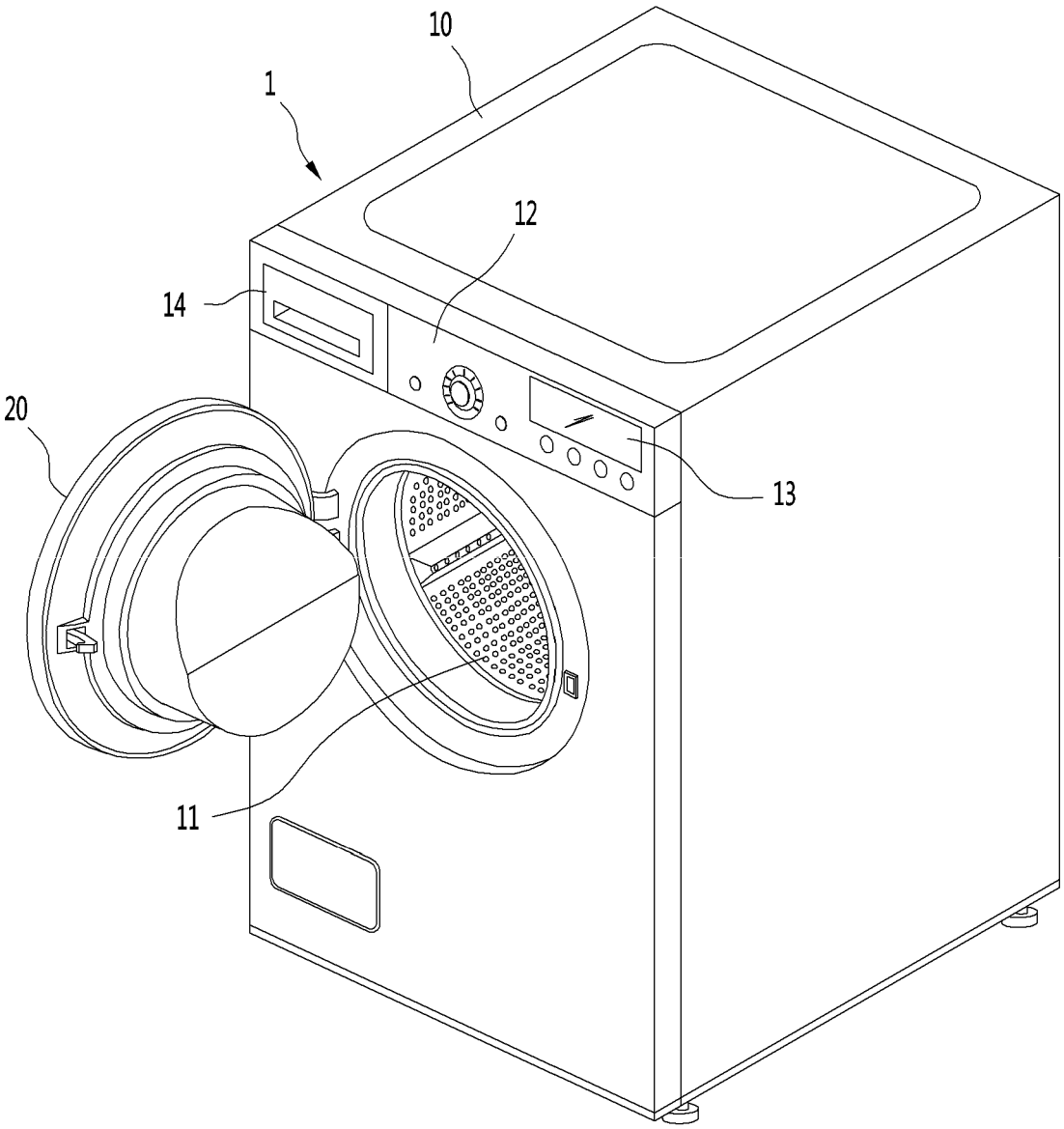
FIG. 1 is a perspective view illustrating a dryer according to an embodiment of the present invention.
Figure 2:
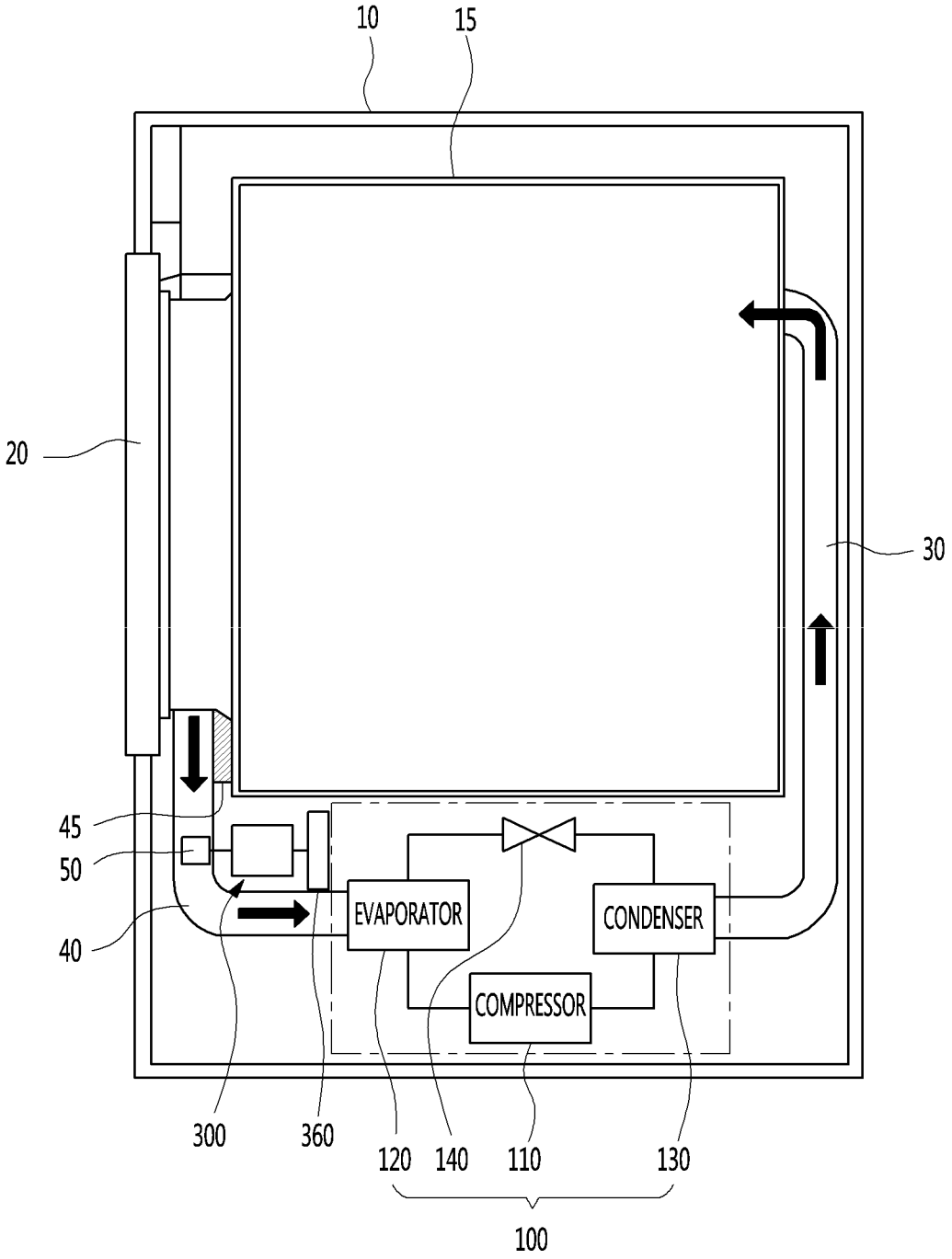
FIG. 2 is a schematic view illustrating an internal configuration of a dryer according to an embodiment of the present invention.
Figure 3:
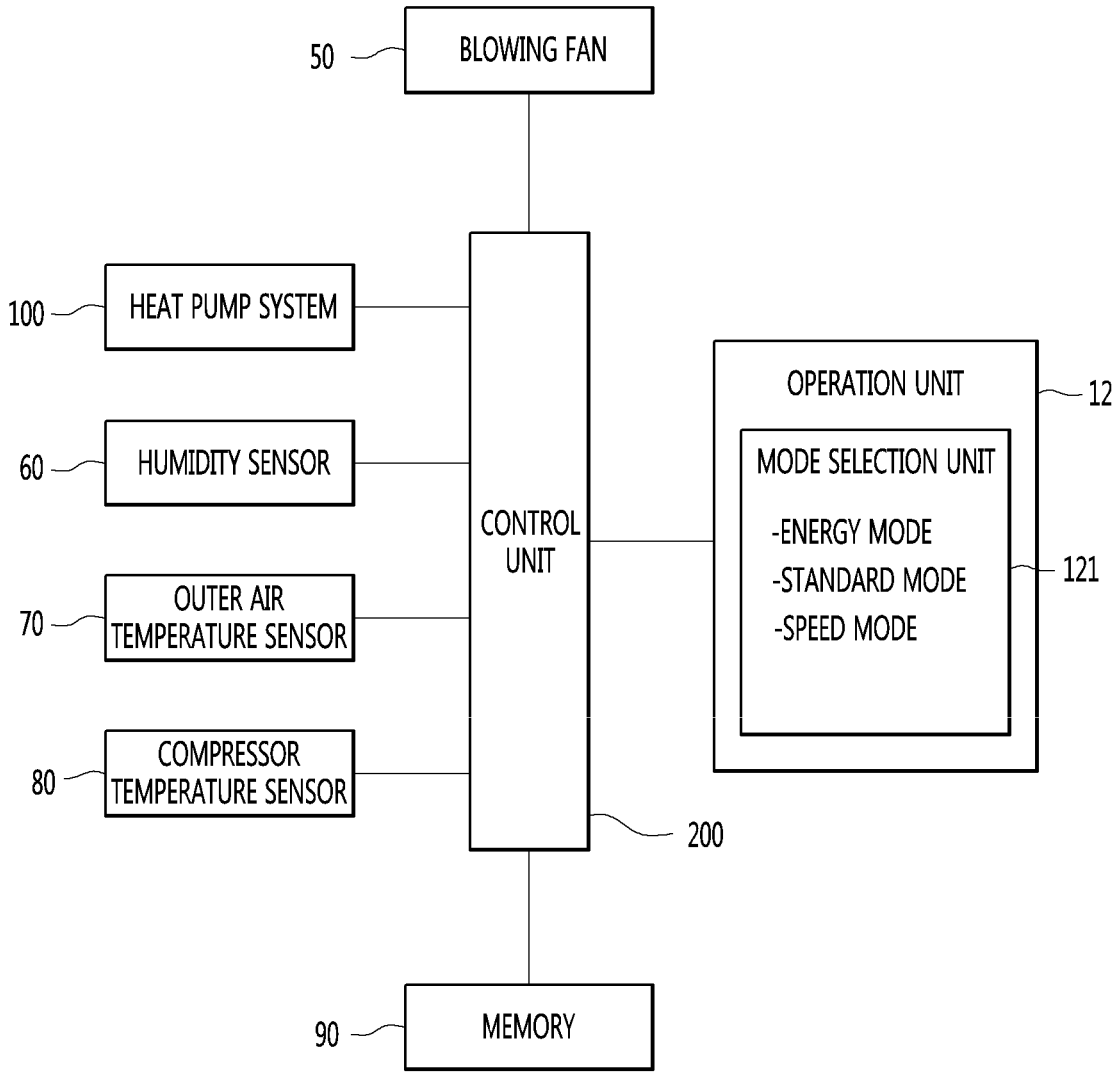
FIG. 3 is a configuration view illustrating a main configuration of a dryer according to an embodiment of the present invention.

FIG. 1 is a perspective view illustrating a dryer according to an embodiment of the present invention, FIG. 2 is a schematic view illustrating an internal configuration of a dryer according to an embodiment of the present invention, and FIG. 3 is a configuration view illustrating a main configuration of a dryer according to an embodiment of the present invention.

A dryer 1 according to an embodiment of the present invention may forms overall an outer appearance by a main body 10 which has an input port 11 for inputting clothes at one side and a door 20 which opens and closes the input port 11.

Inside the main body 10, a drum 15, which is rotatably installed and in which clothes are dried, may be provided. The drum 15 is opened toward the input port 11 and can be provided to allow a user to input clothes into the drum 15 through the input port 11.

The main body 10 may be provided with an operation unit 12 for operating the dryer 1. The operation unit 12 may be located above the input port 11.

The operation unit 12 may be provided with an operation button, a rotary switch, or the like for selecting a function provided to the dryer 1. For example, the user can operate the operation button or the rotary switch provided on the operating unit 12 to turn on or off the power of the dryer 1, input an operation start or drive stop command, and set an operation mode, a drying time, and the like.

The operation unit 12 may further include a display 13. The display 13 may output an operation state of the dryer 1, a set operation mode, time information, and the like.

A drawer 14 may be provided on one side of the main body 10, and liquid or the like to be sprayed onto the drum may be stored inside the drawer 14.

The main body 10 may be provided with a driving motor 300 that provides rotation power to the drum 15. A power transmitting member 360 for rotating the drum 15 is provided on one rotation axis of the driving motor 300 and the drum is connected to the driving motor 300 by the power transmitting member 360 to be capable of receiving power. The power transmitting member 360 may be a pulley or a roller.

The main body 10 may be provided with a supply flow path which supplies air heated to the drum 15 and a duct which forms an exhaust flow path through which the air inside the drum 15 is discharged. The duct may include a supply duct 30 which forms the supply flow path and an exhaust duct 40 which forms the exhaust flow path.

In addition, the main body 10 may be provided with a blowing fan 50 for forcing the flow of air. The blowing fan 50 communicates with the supply duct 30 and the exhaust duct 40 and can force to supply air into the drum 15 through the supply duct 30 and to discharge air in the drum 15 through the discharge duct.

The air blowing fan 50 is provided on the exhaust flow path so that the air discharged from the drum 15 can be sucked into the exhaust duct 40.

The blowing fan 50 may be provided to be connected to the rotation shaft of the driving motor and to rotate simultaneously with the drum 15. Of course, the blowing fan 50 may be connected to a motor separate from the driving motor so as to be rotated independently of the drum 15.

Meanwhile, the embodiments of the present invention will be described with reference to a circulation type dryer in which air in the dryer is circulated, as an example. However, the present invention is not limited to the circulation type dryer and can be applied to an exhaust type dryer.

In a case where the dryer 1 is a circulating type dryer, the exhaust duct 40 may be provided to guide forced air to the supply duct 30.

Meanwhile, in a case where the dryer 1 is an exhaust type dryer, the exhaust duct 40 may be provided to guide the forced air to the outside.

The supply duct 30 may extend to the rear side of the drum 15 and may have a discharge port through which heated air is discharged to the drum at an end portion thereof.

The exhaust duct 40 extends to the front lower side of the drum 15, and a suction port through which the air inside the drum is sucked may be formed at an end portion thereof.

A heater (not illustrated) may be further provided on the supply flow path of the supply duct 30 to heat the supplied air by electric resistance heat. As the heater is provided, the heating properties of the supplied air can be further improved.

A filter 45 may be provided on the exhaust flow path of the exhaust duct 40 to filter foreign matters such as lint contained in the air discharged from the drum 10.

Meanwhile, the main body 10 may be provided with a heat pump system 100 for absorbing waste heat from the air discharged from the drum 15 and heating the air supplied to the inside of the drum 15.

The heat pump system 100 may include an evaporator 120 for cooling the air discharged from the inside of the drum 15, a compressor 110 for compressing the refrigerant, a condenser 130 for heating air supplied in the drum 15, and an expansion valve 140. According to this, the heat pump system 100 may constitute a thermodynamic cycle.

The evaporator 120, the compressor 110, the condenser 130, and the expansion valve 140 may be sequentially connected by piping. The refrigerant can be circulated through the pipe.

The refrigerant may be compressed by the compressor 110 to be in a gaseous state at a high temperature and a high pressure. Then, the refrigerant is in a high-temperature and high-pressure liquid state at the condenser 130 and can perform heat exchange with low-temperature air to be supplied to the drum 15. Then, the refrigerant can be expanded in the expansion valve 140 to become a low-temperature low-pressure gas state. The evaporator 120 can perform heat exchange with the hot and humid air discharged from the drum 15.

The air supplied to the drum 15 can perform heat exchange in the condenser 130 and heated to a high temperature. The hot and humid air discharged from the drum 15 performs heat exchange in the evaporator 120, cooled, remove moisture, and become a dried state. The moisture contained in the hot and humid air can be condensed in the evaporator 120, collected as water, and can be discharged to the outside through a drain pipe (not illustrated).

The evaporator 120 may be provided on an exhaust flow path of the exhaust duct 40. The condenser 130 may be provided on the supply flow path of the supply duct 30.

A machine chamber communicating the exhaust duct 40 and the supply duct 30 with each other may be formed in the main body 10. The compressor 110 and the expansion valve 140 may be provided in the machine chamber. In addition, the driving motor may be also provided in the machine chamber.

Meanwhile, the dryer 1 may further include a control unit 200 (e.g., controller) which controls the overall operation of the dryer 1 and a memory 90 which stores information such as algorithm data and set value data related to the operation of the dryer 1.

In addition, the dryer 1 may further include an outer air temperature sensor 70 for measuring an outer temperature and a compressor temperature sensor 80 for measuring the temperature of the compressor 110.

The compressor temperature sensor 80 may be provided to measure the outlet side temperature of the compressor 110.

In addition, the dryer 1 may further include a humidity sensor 60. The humidity sensor 60 may be provided to measure the degree of drying of the object to be dried accommodated in the drum 15 or to detect whether or not wet clothes have been input. To this end, the humidity sensor 60 may be provided inside the drum 15.

The operation unit 12, the driving motor, the compressor 110, the memory 90, the outer air temperature sensor 70, the compressor temperature sensor 80, and the humidity sensor 60 may be electrically connected to the control unit 200.

The control unit 200 can detect an operation signal of the operation unit 12 and check information corresponding to the input operation signal from the memory 90. According to the information stored in the memory 90, the operation of the driving motor and the compressor 110 can be controlled. For example, when the drying start command is inputted from the operating unit 12, the control unit 200 drives the driving motor and the compressor 110 to start drying. When the drying termination command is inputted, the driving of the driving motor and the compressor 110 is stopped to terminate the drying.

The control unit 200 may control the operation of the dryer 1 according to information input from the outer air temperature sensor 70, the compressor temperature sensor 80 and the humidity sensor 60.

Specifically, the control unit 200 may control the operation mode of the heat pump system 100 differently based on the temperature input from the outer air temperature sensor 70.

The control unit 200 may switch the operation mode of the heat pump system 100 based on the temperature input from the compressor temperature sensor 80 or control the driving rotational speed of the compressor 110 to control the load. This will be described in more detail with reference to FIG. 4.

The control unit 200 determines whether or not wet clothing is input based on the humidity information input from the humidity sensor 60 and only in a case where the inputting of wet clothing is checked, the driving motor and the compressor 110 can be controlled so as to be operated. Then, the driving of the driving motor and the compressor 110 can be stopped by determining the drying state of the clothes based on the humidity information.

In addition, when the temperature of the inside of the drum 15 reaches a suitable temperature after the compressor 110 is driven, the control unit 200 lowers the rotation speed of the compressor 110 and the inside of the drum 15 be maintained at a temperature suitable for drying.

In this case, the dryer 1 is further provided with a separate temperature sensor for measuring the temperature inside the drum 15, and the control unit 200 can detect the temperature of the inside of the drum 15 through a temperature sensor which measures the temperature inside the drum 15.

Alternatively, the control unit 200 may determine whether or not the temperature inside the drum 15 has reached an appropriate temperature, based on the outlet side temperature of the compressor detected by the compressor temperature sensor 80.

Meanwhile, the compressor 110 may be a twin rotary type compressor. The twin-rotor compressor may have a structure in which two refrigerant compression chambers are vertically formed thereon and two eccentric rollers which are eccentrically rotated by a single drive shaft and compress the refrigerant are installed in the compression chamber so as to have a phase difference of 180 degrees.

The twin rotary compressors have features in which the two eccentric rollers continuously compress refrigerant at the upper and lower portions to improve the compression efficiency of the compressor and reduce vibration and noise.

The compressor 110 can reduce vibrations and noise while providing a higher compression efficiency as compared with a single type compressor having the same volume and only one compression chamber. Accordingly, it is possible to improve the drying performance of the dryer 1 by providing a higher compression efficiency without further consuming a space for accommodating the compressor 110 in the dryer 1.

Meanwhile, the compressor 110 can variably control the driving speed by the control unit 200, and the heating properties of the air can be controlled by varying the driving speed of the compressor 110. In other words, the control unit 200 may vary the operation frequency Hz of the compressor 110.

At this time, as the compressor 110 is applied to a twin rotary compressor, the noise can be reduced in the high-frequency range and the vibration can be reduced in the low-frequency range, as compared with the single type compression. Thus, it is possible to further expand the maximum frequency and the minimum frequency while providing a noise and vibration level that the user is satisfied with.

For example, the frequency driving range of the compressor 110 can be variably controlled from a minimum of 30 Hz to a maximum of 90 Hz.

Meanwhile, as the refrigerant used in the heat pump system 100 R134a can be applied. Of course, various fluids such as R245fa may be used as a refrigerant, but in the embodiment of the present invention, R134a refrigerant is applied as an example.

Since the R134a refrigerant has a high discharge temperature characteristic, it is advantageous to heat the air supplied from the condenser 130 to the drum 15.

Meanwhile, the operation unit 12 may be provided with a mode selection unit 121 for selecting an operation mode of the dryer 1 as an energy mode, a standard mode, and a speed mode.

The energy mode is a mode for reducing power consumption, and the initial driving frequency of the compressor 110 may be the lowest mode among the operation modes.

The standard mode may be a mode in which the initial driving frequency of the compressor 110 is higher than the energy mode and lower than the speed mode.

The speed mode is a mode for maximizing the drying performance of the dryer 1, and the initial driving frequency of the compressor 110 may be higher than the standard mode.

For example, in a case where the dryer 1 is operated in the energy mode, the compressor 110 may be initially accelerated to 50 Hz. In a case where the compressor 110 is operated in the standard mode, the compressor 110 may be accelerated to an initial speed of 75 Hz. In a case where the compressor 110 is operated in the speed mode, the compressor 110 may be initially accelerated to 90 Hz.

Meanwhile, the energy mode, the spin mode, and the speed mode may have variable frequency sections of the compressor 110, respectively.

The compressor 110 can be controlled so that the frequency is lowered to maintain the temperature inside the drum 15 when the temperature inside the drum 15 reaches a suitable temperature for drying.

At this time, the control unit 200 can determine whether or not the temperature inside the drum 15 has reached the suitable temperature based on the temperature measured by the compressor temperature sensor 80.

For example, the control unit 200 may determine that the temperature inside the drum 15 has reached a suitable temperature when the temperature measured by the compressor temperature sensor 80 is 85 degrees. At this time, the temperature inside the drum 15 may be different according to the operation mode, and the speed mode may be the highest and the energy mode may be the lowest.

Meanwhile, the minimum frequency of the compressor 110 in the speed mode may be higher than the minimum frequency of the compressor 110 in the standard mode. The minimum frequency of the compressor 110 in the energy mode may be lower than the minimum frequency of the compressor 110 in the standard mode.

In other words, the energy mode may be a mode in which the maximum frequency and the minimum frequency of the compressor 110 among the operation modes are the lowest. The speed mode may be a mode in which the maximum frequency and the minimum frequency of the compressor 110 are the highest among the operation modes.

For example, the frequency variable range of the compressor 110 in the energy mode may be 50 Hz-35 Hz. The frequency variable range of the compressor 110 in the standard mode may be 75 Hz-48 Hz. The frequency variable range of the compressor 110 in the speed mode may be 90 Hz-60 Hz.

The user can select one of the energy mode, the standard mode, and the speed mode by operating the operation unit 12. For example, in a case where the power consumption is to be reduced, the energy mode can be selected, and in a case where the rapid drying is desired, the speed mode can be selected.

The control unit 200 may control the heat pump system 100 differently according to the operation mode selected by the user.

Meanwhile, in a case where the outer temperature is lower than the predetermined temperature, the control unit 200 may determine as the low-temperature state and ignore the operation mode selected by the user and control the dryer 1 to operate in the speed mode.

Meanwhile, when it is determined that the compressor 110 is overheated, the control unit 200 may switch the dryer 1 to the low-speed mode to prevent the compressor 110 from being damaged.

The low-speed mode may be defined as a mode in which the frequency of the compressor 110 is lower than the minimum frequency of the current operation mode.

For example, in a case where the compressor 110 is operated in the speed mode, the frequency of the compressor 110 may be controlled to be lower than 60 Hz, which is the minimum frequency of the speed mode when the low-speed mode is performed. In a case where the compressor 110 is operating in the energy mode, the frequency of the compressor 110 may be controlled to be lower than 35 Hz, which is the minimum frequency of the energy mode, when the low-speed mode is performed.

In the low-speed mode, the frequency of the compressor 110 may be lower than 35 Hz, which is the minimum frequency of the energy mode. For example, the frequency of the compressor can be lowered to at least 30 Hz.

Meanwhile, when the low-speed mode is performed, the frequency of the compressor 110 may be controlled so as to be stepwise reduced to 30 Hz which is the minimum frequency of the low-speed mode of the compressor 110. Alternatively, it may be controlled so as to immediately decelerate to 30 Hz, which is the minimum frequency of the low-speed mode, and then maintain the minimum frequency.

Hereinafter, a control method of the dryer 1 according to an embodiment of the present invention will be described in detail with reference to the drawings.

Figure 4:
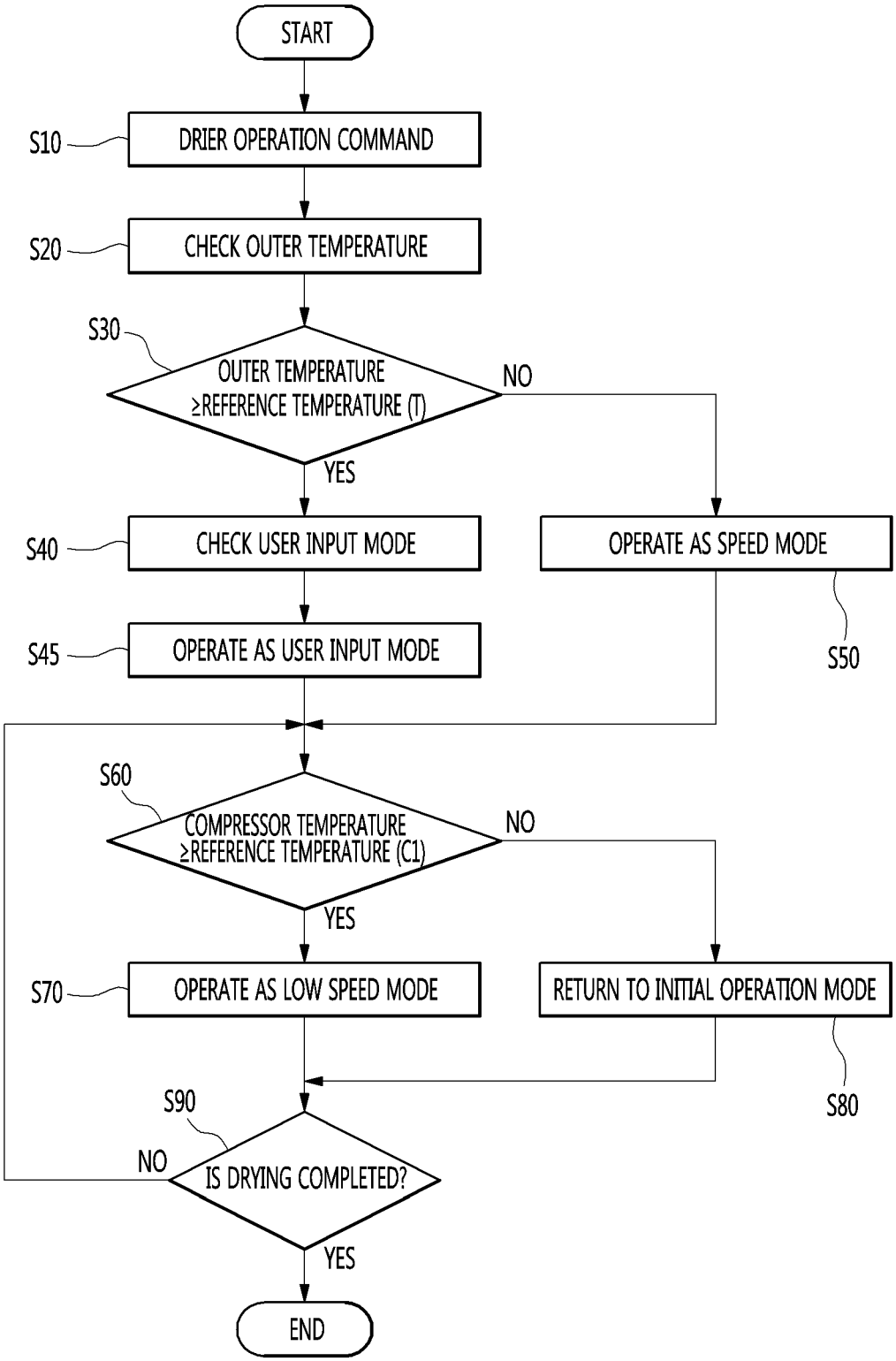
FIG. 4 is a flowchart of a control method of the dryer 1 according to the embodiment of the present invention.

FIG. 4 is a flowchart of a control method of the dryer 1 according to the embodiment of the present invention.

A user can input an operation command to the dryer 1 by operating the operation unit 12. At this time, the user can select one of the energy mode, the standard mode, and the speed mode through the operation of the operation unit 12 [S10].

When the operation command is input to the dryer 1, the control unit 200 can check the outer temperature. The outer temperature can be measured at the outer air temperature sensor 70. The measured outer temperature may be transmitted to the control unit 200. Accordingly, the control unit 200 can detect the outer temperature [S20].

The control unit 200 may compare the detected outer temperature with a reference temperature T, which is a preset temperature value. In detail, the control unit 200 may determine whether or not the detected outer temperature is equal to or more than, or less than the reference temperature T. The reference temperature T may be stored in the memory 90 and provided.

The reference temperature T may be a temperature lower than 10 degrees and may be set to, for example, 5° C. [S30].

In a case where the outer temperature is equal to or more than the reference temperature T, the control unit 200 can check the operation mode selected by the user. In other words, one of the energy mode, the standard mode, and the speed mode which is selected by the user can be checked [S40].

In a case where the outer temperature is equal to or more than the reference temperature T, the control unit 200 can determine as the room temperature and operate the dryer 1 in the operation mode selected by the user.

For example, in a case where the user selects the energy mode, the compressor 110 may be initially accelerated to 50 Hz to drive the heat pump system 100. Then, the blowing fan 50 and the drum 15 are operated to allow drying with low power consumption.

In a case where the user selects the standard mode, the compressor 110 may be initially accelerated to 75 Hz to drive the heat pump system 100. Then, the blowing fan 50 and the drum 15 can be operated to perform drying.

In a case where the user selects the speed mode, the compressor 110 may be initially accelerated to 90 Hz to drive the heat pump system 100. In addition, the blowing fan 50 and the drum 15 can be operated to increase the heating properties of the air supplied to the drum 15. According to this, drying can be performed rapidly.

Meanwhile, when it is determined that the internal temperature of the drum 15 has reached the suitable temperature for drying, the control unit 200 may lower stepwise the frequency of the compressor 110 to a predetermined level.

At this time, the control unit 200 compares the temperature measured by the compressor temperature sensor 80 with a preset reference temperature C2 and when the temperature measured by the compressor temperature sensor 80 reaches a reference temperature C2, can be determined that the inside of the drum 15 has reached the suitable temperature. For example, the reference temperature C2 may be 85 degrees.

The control unit 200 continuously checks the temperature measured by the compressor temperature sensor 80 at a predetermined cycle and lowers the frequency of the compressor 110 by a frequency reduction value H1 selected for each when the temperature reaches the reference temperature C2.

At this time, the set frequency reduction value H1 may be 1 Hz.

In the energy mode, the frequency of the compressor 110 may be lowered to 35 Hz. In the standard mode, the frequency of the compressor 110 may be lowered to 48 Hz. In the speed mode, the frequency of the compressor 110 may be lowered to 60 Hz [S45].

On the other hand, in a case where the outer temperature is lower than the reference temperature T, the control unit 200 may determine the driving environment of the dryer 1 as a low-temperature condition. Accordingly, the control unit 200 can operate the dryer 1 in the speed mode while ignoring the operation mode selected by the user. In other words, in a case where the outer temperature is equal to or less than the reference temperature T, the dryer 1 can be operated in the speed mode even if the energy mode and the standard mode are selected by the user.

At this time, the control unit 200 may initially accelerate the compressor 110 to 90 Hz to drive the heat pump system 100. The drying operation can be rapidly performed by operating the blowing fan 50 and the drum 15 so as to increase the heating properties of air supplied to the drum 15.

As in step S45, if the control unit determines that the internal temperature of the drum 15 has reached the suitable temperature for drying, the control unit 200 can decrease stepwise the frequency of the compressor 110 to a predetermined level [S50].

Meanwhile, when the compressor 110 is overheated, the compressor 110 may be damaged.

In order to prevent this, the control unit 200 may determine whether the temperature of the compressor 110 is overheated.

The control unit 200 may determine the overheated state of the compressor 110 through the surface temperature of the compressor 110 and in this case, a separate temperature sensor for measuring the surface temperature of the compressor 110 is further provided.

Alternatively, the control unit 200 may determine the overheating state of the compressor 110 through the outlet side temperature of the compressor 110 detected by the compressor temperature sensor 80.

Hereinafter, for example, a case where the control unit 200 determines whether or not the compressor 110 is heated or overheated based on the outlet side temperature of the compressor 110 will be described.

The control unit 200 can compare the temperature detected by the compressor temperature sensor 80 with the reference temperature C1 which is a preset temperature value and determine whether or not the outlet side temperature of the compressor 110 is equal to or more than, or less than the reference temperature C1.

The reference temperature C1 may be stored in the memory 90 and provided and may be a temperature value higher than the reference temperature C2. For example, the reference temperature C1 may be set to 95 degrees [S60].

In a case where the outlet side temperature of the compressor 110 is equal to or more than the reference temperature C1, the control unit 200 may perform a low-speed mode to prevent damage to the compressor 110 due to overheating.

As described above, the low-speed mode may be defined as a mode of operating the frequency of the compressor 110 to be less than the minimum frequency of the current operation mode.

When the low-speed mode is performed, the frequency of the compressor 110 may be controlled to be stepwise reduced to 30 Hz, which is the minimum frequency of the low-speed mode of the compressor 110. Alternatively, the frequency of the compressor may be controlled to immediately decelerate to 30 Hz, which is the minimum frequency of the low-speed mode, and then maintain the minimum frequency.

In a case where the frequency of the compressor 110 is controlled to decrease stepwise, the control unit 200 can continuously check the outlet side temperature of the compressor 110 at a predetermined cycle. In a case where the outlet side temperature of the compressor 110 is equal to or more than the reference temperature C2, the frequency of the compressor 110 may be lowered by a set frequency reduction value H2. At this time, the set frequency reduction value H2 may be 5 Hz [S70].

Meanwhile, in a case where the outlet side temperature of the compressor 110 is less than the reference temperature C1, the control unit 200 can control the dryer 1 to continuously operate in the initial operation mode in which the dryer 1 is in operation. The initial operation mode may be one of the energy mode, the standard mode, and the speed mode, as an operation mode at the time of driving state of the dryer 1.

In addition, the control unit 200 can continuously check the outlet side temperature of the compressor 110 even after the low-speed mode is performed. When the outlet side temperature of the compressor 110 decreases below the reference temperature C1, the control unit 200 allows the dryer 1 to be released from the low-speed mode and to be returned to the initial operation mode before the low-speed mode is performed [S80].

The control unit 200 may stop the driving of the drum 15 and the compressor 110 when the drying of the input cloth is completed [S90].

In the dryer 1 according to the embodiment of the present invention described above, the following effects can be expected.

First, when the outer temperature is less than the reference temperature T, the control unit determines that the operating environment of the dryer is in a low-temperature, ignores the operation mode selected by the user, forcibly performs the operation mode in which the initial driving frequency of the compressor of the plurality of operation modes. Therefore, in a situation where the outer temperature is low, the heat pump system can achieve sufficient heating properties, thereby preventing an excessive drying time from being generated. Therefore, it is possible to prevent the generation of the user complaints about the performance of the dryer.

Second, the control unit checks the outlet side temperature of the compressor, and in a case where the outlet side temperature of the compressor is more than the reference temperature C1, the control unit determines that the compressor is overloaded and performs the low-speed mode. At this time, since the low-speed mode decelerates the compressor to a frequency less than the variable minimum frequency of the compressor in the operation mode being performed, the load of the compressor is reduced. Thus, the compressor can be prevented from being damaged by the high temperature.

Third, the lowest frequency of the compressor in the low-speed mode is larger than OHz. In other words, the compressor is operated at a low-speed in a state where the compressor is overloaded, so that the air can be continuously heated. Therefore, drying performance can be improved.

Fourth, in the low-speed mode, the control unit checks the outlet side temperature of the compressor at a constant cycle and decreases stepwise the outlet side temperature of the compressor. Therefore, the compressor is rapidly cooled, the heating properties are prevented from being lowered, and the optimum performance can be achieved while reducing the load.

Fifth, as compressors are applied as twin rotary compressors, vibration and noise at high and low frequencies can be minimized. Thus, the maximum frequency and minimum frequency range of the compressor can be expanded while maintaining vibration and noise levels at customer satisfaction levels. Therefore, it is possible to further secure a frequency range of the low-speed mode in which the lowest frequency is less than the operation mode. In addition, since the maximum frequency can increase, the drying performance can be further improved.

What is claimed is:

1. A dryer comprising:

a main body on which an input port is formed;

a drum rotatably installed in the main body;

a driving motor configured to provide rotation power to the drum;

a blowing fan configured to force a flow of air to the main body;

a heat pump system including a condenser, an evaporator, and a compressor so as to heat air supplied to the drum;

an outer air temperature sensor configured to measure an outer temperature; and a controller configured to control a plurality of operation modes by comparing the measured outer temperature with a preset reference temperature, wherein the controller is configured to:

control the dryer in a first mode when the measured outer temperature is greater than or equal to the preset reference temperature, and control the dryer in a second mode when the measured outer temperature is less than the preset reference temperature, wherein the first mode is defined as operating in a previously input operation mode continuously, wherein the second mode is defined as operating in an operation mode in which an operation frequency of the compressor is higher than the previously input operation mode, and wherein the plurality of operation modes includes:

a speed mode in which an initial driving frequency and a variable minimum frequency of the compressor are highest, a standard mode in which the initial driving frequency and the variable minimum frequency of the compressor are lower than the speed mode, and an energy mode in which the initial driving frequency and the variable minimum frequency of the compressor are lower than the standard mode.

2. The dryer according to claim 1, wherein the second mode is defined to be the speed mode having the highest initial driving frequency of the compressor among the plurality of operation modes.

3. The dryer according to claim 1, wherein the previously input operation mode is an operation mode input by a user among the plurality of operation modes.

4. The dryer according to claim 1, wherein the controller is configured to determine a driving environment of the dryer as a room temperature state or a lower temperature state by comparing the outer temperature with the preset reference temperature.

5. The dryer according to claim 1, wherein the controller is configured to determine a driving environment of the dryer as a room temperature state controlled by the first mode or a lower temperature state controlled by the second mode based on comparing the measured outer temperature with the preset reference temperature.

6. The dryer according to claim 1, wherein the controller is configured to detect an outlet side temperature of the compressor to determine whether the compressor is overloaded.

7. The dryer according to claim 1, further comprising:

a compressor temperature sensor provided on an outlet side of the compressor and configured to measure an outlet side temperature of the compressor.

8. The dryer according to claim 7, wherein the controller is configured to determine whether the compressor is overloaded by comparing a first preset reference temperature (C1) with the measured outlet side temperature of the compressor.

9. The dryer according to claim 8, wherein the controller is configured to determine that the compressor is in an overloaded state when the measured outlet side temperature of the compressor is equal to or more than the first preset reference temperature (C1).

10. The dryer according to claim 9, wherein the controller is configured to, in the overloaded state, control the dryer to perform a low-speed mode which is specified so as to operate at a variable frequency lower than the variable minimum frequency of the compressor.

11. The dryer according to claim 10, wherein the controller is configured to, in the low-speed mode, check the outlet side temperature of the compressor at a predetermined cycle and further configured to decrease stepwise the operation frequency of the compressor by a second set frequency reduction value (H2).

12. The dryer according to claim 7, wherein the controller is configured to determine whether a temperature inside the drum has reached a suitable condition for drying by comparing the outlet side temperature of the compressor with a second preset reference temperature (C2).

13. The dryer according to claim 1, further comprising a humidity sensor provided inside the drum, wherein the controller is configured to determine a drying state of clothes based on humidity information detected by the humidity sensor.

14. The dryer according to claim 1, further comprising:

a supply duct communicating with the blowing fan and configured to guide heated air to the drum; and a discharge duct communicating with the blowing fan and configured to suck air in the drum, wherein the condenser is provided on a supply flow path of the supply duct, and the evaporator is provided on a discharge flow path of the discharge duct.

* * * * *